US011798473B2

(12) United States Patent
Liu et al.

(10) Patent No.: US 11,798,473 B2
(45) Date of Patent: Oct. 24, 2023

(54) PIXEL DRIVING CIRCUIT AND DISPLAY PANEL

(71) Applicant: BOE TECHNOLOGY GROUP CO., LTD., Beijing (CN)

(72) Inventors: Dongni Liu, Beijing (CN); Minghua Xuan, Beijing (CN); Haoliang Zheng, Beijing (CN); Li Xiao, Beijing (CN); Liang Chen, Beijing (CN); Zhenyu Zhang, Beijing (CN); Jiao Zhao, Beijing (CN); Hao Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 149 days.

(21) Appl. No.: 17/309,917

(22) PCT Filed: Sep. 28, 2020

(86) PCT No.: PCT/CN2020/118279
§ 371 (c)(1),
(2) Date: Jun. 29, 2021

(87) PCT Pub. No.: WO2022/061852
PCT Pub. Date: Mar. 31, 2022

(65) Prior Publication Data
US 2022/0319417 A1 Oct. 6, 2022

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2300/0426* (2013.01);
(Continued)

(58) Field of Classification Search
None
See application file for complete search history.

(56) References Cited

U.S. PATENT DOCUMENTS

2008/0211746 A1* 9/2008 Caligiore ..... G09G 3/3233 345/76
2021/0351260 A1* 11/2021 Kim ..... G09G 3/3233
(Continued)

FOREIGN PATENT DOCUMENTS

CN 103700338 A 4/2014
CN 109166528 A 1/2019
(Continued)

*Primary Examiner* — Matthew Yeung
(74) *Attorney, Agent, or Firm* — Nath, Goldberg & Meyer; Joshua B. Goldberg

(57) ABSTRACT

The present disclosure provides a pixel driving circuit and a display panel. The pixel driving circuit includes: a data writing sub-circuit configured to transmit a data voltage signal to a first terminal of a driving sub-circuit in response to a first scanning signal; a threshold compensation sub-circuit configured to compensate for a threshold voltage of the driving sub-circuit in response to a second scanning signal; a storage sub-circuit configured to store the data voltage signal; the driving sub-circuit configured to provide a driving current for a light emitting device to be driven according to voltages of a first terminal and a control terminal of the driving sub-circuit; and a voltage maintaining sub-circuit configured to maintain the voltage of the control terminal of the driving sub-circuit when the voltage of the first terminal of the driving sub-circuit jumps.

19 Claims, 8 Drawing Sheets

(52) U.S. Cl.
CPC ..... *G09G 2300/0819* (2013.01); *G09G 2300/0842* (2013.01); *G09G 2300/0861* (2013.01); *G09G 2310/08* (2013.01)

(56) References Cited

U.S. PATENT DOCUMENTS

| | | | | |
|---|---|---|---|---|
| 2021/0407412 | A1* | 12/2021 | Kim | G09G 3/3233 |
| 2022/0230592 | A1* | 7/2022 | Zhao | G09G 3/3258 |

FOREIGN PATENT DOCUMENTS

| | | | |
|---|---|---|---|
| CN | 110491335 | A | 11/2019 |
| CN | 111247579 | A | 6/2020 |
| CN | 111292683 | A | 6/2020 |

* cited by examiner

PIXEL DRIVING CIRCUIT AND DISPLAY PANEL

This is a National Phase Application filed under 35 U.S.C. 371 as a national stage of PCT/CN2020/118279, filed Sep. 28, 2020, the content of which is hereby incorporated by reference in its entirety.

TECHNICAL FIELD

The present disclosure relates to the field of display technology, and particularly relates to a pixel driving circuit and a display panel.

BACKGROUND

At present, Micro Light Emitting Diode (Micro LED) display technology is being developed in a day by day, and due to its outstanding advantages such as a miniature volume, a low power consumption, a high color saturation, a high reaction speed, a long service life and the like, a majority of scientific and technological workers are attracted to invest in research.

SUMMARY

The present disclosure is directed to at least one of technical problems of the related art, and provides a pixel driving circuit and a display panel.

In a first aspect, an embodiment of the present disclosure provides a pixel driving circuit, which includes: a data writing sub-circuit, a threshold compensation sub-circuit, a driving sub-circuit, a storage sub-circuit and a voltage maintaining sub-circuit;

the data writing sub-circuit is configured to transmit a data voltage signal to a first terminal of the driving sub-circuit in response to a first scanning signal;

the threshold compensation sub-circuit is configured to compensate for a threshold voltage of the driving sub-circuit in response to a second scanning signal;

the storage sub-circuit is configured to store the data voltage signal;

the driving sub-circuit is configured to provide a driving current for a light emitting device to be driven according to voltages of a first terminal and a control terminal of the driving sub-circuit; and the voltage maintaining sub-circuit is configured to maintain the voltage of the control terminal of the driving sub-circuit when the voltage of the first terminal of the driving sub-circuit jumps.

In some implementations, the voltage maintaining sub-circuit includes a first capacitor, a first electrode of the first capacitor is coupled to the control terminal of the driving sub-circuit, and a second electrode of the first capacitor is coupled to a second terminal of the driving sub-circuit.

In some implementations, the voltage maintaining sub-circuit includes a first capacitor, a first electrode of the first capacitor is coupled to the control terminal of the driving sub-circuit, and a second electrode of the first capacitor is coupled to a reference voltage terminal.

In some implementations, a capacitance value of the first capacitor is in a range from 0.1 pF to 10 pF.

In some implementations, the pixel driving circuit further includes:

a first light emitting control sub-circuit configured to control whether a first voltage is written to a first terminal of a first driving sub-circuit of the driving sub-circuit in response to a first light emitting control signal.

In some implementations, the first light emitting control sub-circuit includes a first light emitting control transistor;

a first electrode of the first light emitting control transistor is coupled to a first power supply voltage line, a second electrode of the first light emitting control transistor is coupled to the first terminal of the driving sub-circuit, and a control electrode of the first light emitting control transistor is coupled to a first light emitting control line.

In some implementations, the pixel driving circuit further includes:

a first reset sub-circuit configured to reset the voltage of the control terminal of the driving sub-circuit through a first initialization signal in response to a first reset control signal.

In some implementations, the first reset sub-circuit includes a first reset transistor;

a first electrode of the first reset transistor is coupled to a first initialization signal terminal, a second electrode of the first reset transistor is coupled to the control terminal of the driving sub-circuit, and a control electrode of the first reset transistor is coupled to a first reset control signal line.

In some implementations, the pixel driving circuit further includes: a second light emitting control sub-circuit configured to allow a current between the driving sub-circuit and the light emitting device to be driven in response to a second light emitting control signal or not.

In some implementations, the second light emitting control sub-circuit includes a second light emitting control transistor;

a first electrode of the second light emitting control transistor is coupled to the second terminal of the driving sub-circuit, a second electrode of the second light emitting control transistor is coupled to a first electrode of the light emitting device to be driven, and a control electrode of the second light emitting control transistor is coupled to a second light emitting control line.

In some implementations, the pixel driving circuit further includes:

a second reset sub-circuit configured to initialize the light emitting device to be driven by a second initialization signal in response to a second reset control signal.

In some implementations, the second reset sub-circuit includes a second reset transistor;

a first electrode of the second reset transistor coupled to the first electrode of the light emitting device to be driven, a second electrode of the second reset transistor is coupled to a second initialization signal terminal, and a control electrode of the second reset transistor is coupled to a second reset control signal line.

In some implementations, the pixel driving circuit further includes:

a time control sub-circuit configured to control a light emitting time duration of the light emitting device to be driven through a time modulation signal and a third light emitting control signal in response to a time control signal.

In some implementations, the time control sub-circuit includes a first time modulation transistor, a second time modulation transistor, a third light emitting control transistor and a second capacitor;

a first electrode of the first time modulation transistor is coupled to the second terminal of the driving sub-circuit, a second electrode of the first time modulation transistor is coupled to a first electrode of the third light emitting control transistor, and a control electrode of the first time modulation transistor is coupled to a third light emitting control line;

a first electrode of the second time modulation transistor is coupled to a time modulation signal terminal, a second electrode of the second time modulation transistor is coupled to a control electrode of the third light emitting control transistor, and a control electrode of the second time modulation transistor is coupled to a time control signal line;

a second electrode of the third light emitting control transistor is coupled to the first electrode of the light emitting device to be driven, and a control electrode of the third light emitting control transistor is coupled to a first electrode of the second capacitor;

a second electrode of the second capacitor is coupled to a common voltage terminal.

In some implementations, the third light emitting control line is configured to be written with operation level signals for a plurality of times within a display time of a frame, and time durations of the operating level signals are different.

In some implementations, the driving sub-circuit includes a driving transistor, the threshold compensation sub-circuit includes a threshold compensation transistor, the data writing sub-circuit includes a data writing transistor, and the storage sub-circuit includes a storage capacitor;

a first electrode of the driving transistor is used as the first terminal of the driving: sub-circuit, a second electrode of the driving transistor is used as the second terminal of the driving sub-circuit, and a control electrode of the driving sub-circuit is used as the control terminal of the driving sub-circuit;

the first electrode of the driving transistor is coupled to a second electrode of the data writing transistor, the second electrode of the driving transistor is coupled to a first electrode of the threshold compensation transistor, and the control electrode of the driving transistor is coupled to a second electrode of the threshold compensation transistor and a first electrode of the storage capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to the first power supply voltage line.

In some implementations, a capacitance value of the storage capacitor is in a range from 0.1 pF to 10 pF.

An embodiment of the present disclosure further provides a pixel driving circuit, which includes: a data writing sub-circuit, a threshold compensation sub-circuit, a driving sub-circuit, a storage sub-circuit, a first light emitting control sub-circuit, a second light emitting control sub-circuit, a first reset sub-circuit, a second reset sub-circuit and a voltage maintaining sub-circuit;

the driving sub-circuit includes a driving transistor, the threshold compensation sub-circuit includes a threshold compensation transistor, the data writing sub-circuit includes a data writing transistor, the storage sub-circuit includes a storage capacitor, the first light emitting control sub-circuit includes a first light emitting control transistor, the second light emitting control sub-circuit includes a second light emitting control transistor, the first reset sub-circuit includes a first reset transistor, the second reset sub-circuit includes a second reset transistor, and the voltage maintenance sub-circuit includes a first capacitor;

a first electrode of the driving transistor is coupled to a second electrode of the data writing transistor and a second electrode of the first light emitting control transistor, a second electrode of the driving transistor is coupled to a first electrode of the threshold compensation transistor, and a control electrode of the driving transistor is coupled to a second electrode of the threshold compensation transistor, a first electrode of the storage capacitor and a first electrode of the first capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to a first power supply voltage line;

a first electrode of the first light emitting control transistor is coupled to the first power supply voltage line, and a control electrode of the first light emitting control transistor is coupled to a first light emitting control line;

a first electrode of the second light emitting control transistor is coupled to the second electrode of the driving transistor, a second electrode of the second light emitting control transistor is coupled to a first electrode of a light emitting device to be driven, and a control electrode of the second light emitting control transistor is coupled to a second light emitting control line;

a first electrode of the first reset transistor is coupled to a first initialization signal terminal, a second electrode of the first reset transistor is coupled to the control electrode of the driving transistor, and a control electrode of the first reset transistor is coupled to a first reset control signal line;

a first electrode of the second reset transistor is coupled to the first electrode of the light emitting device to be driven, a second electrode of the second reset transistor is coupled to a second initialization signal terminal, and a control electrode of the second reset transistor is coupled to a second reset control signal line;

a second electrode of the first capacitor is coupled to the second electrode of the driving transistor or a reference voltage terminal.

An embodiment of the present disclosure further provides a pixel driving circuit, which includes: a data writing sub-circuit, a threshold compensation sub-circuit, a driving sub-circuit, a storage sub-circuit, a first light emitting control sub-circuit, a first reset sub-circuit, a time control sub-circuit and a voltage maintaining sub-circuit;

the driving sub-circuit includes a driving transistor, the threshold compensation sub-circuit includes a threshold compensation transistor, the data writing sub-circuit includes a data writing transistor, the storage sub-circuit includes a storage capacitor, the first light emitting control sub-circuit includes a first light emitting control transistor, the second light emitting control sub-circuit includes a second light emitting control transistor, the first reset sub-circuit includes a first reset transistor, the second reset sub-circuit includes a second reset transistor, the time control sub-circuit includes a first time modulation transistor, a second time modulation transistor, a third light emitting control transistor and a second capacitor, and the voltage maintaining sub-circuit includes a first capacitor;

a first electrode of the driving transistor is coupled to a second electrode of the data writing transistor and a second electrode of the first light emitting control transistor, a second electrode of the driving transistor is coupled to a first electrode of the threshold compensation transistor, and a control electrode of the driving transistor is coupled to a second electrode of the threshold compensation transistor, a first electrode of the storage capacitor and a first electrode of the first capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to a first power supply voltage line;

a first electrode of the first light emitting control transistor is coupled to the first power supply voltage line, and a control electrode of the first light emitting control transistor is coupled to a first light emitting control line;

a first electrode of the first reset transistor is coupled to a first initialization signal terminal, a second electrode of the first reset transistor is coupled to the control electrode of the driving transistor, and a control electrode of the first reset transistor is coupled to a first reset control signal line;

a first electrode of the first time modulation transistor is coupled to the second electrode of the driving transistor, a second electrode of the first time modulation transistor is coupled to a first electrode of the third light emitting control transistor, and a control electrode of the first time modulation transistor is coupled to a third light emitting control line;

a first electrode of the second time modulation transistor is coupled to a time modulation signal terminal, a second electrode of the second time modulation transistor is coupled to a control electrode of the third light emitting control transistor, and a control electrode of the second time modulation transistor is coupled to a time control signal line;

a second electrode of the third light emitting control transistor is coupled to a first electrode of a light emitting device to be driven, and a control electrode of the third light emitting control transistor is coupled to a first electrode of the second capacitor;

a second electrode of the second capacitor is coupled to a common voltage terminal.

In a second aspect, an embodiment of the present disclosure provides a display panel, which includes a plurality of pixel units, each of the plurality of pixel units including a pixel driving circuit and a light emitting device; the pixel driving circuit is any one of the pixel driving circuits described above.

In some implementations, the light emitting device includes a micro inorganic light emitting diode.

DESCRIPTION OF EMBODIMENTS

In order to make technical solutions of the present disclosure be better understood by a person skilled in the art, the present disclosure is further described in detail with reference to the accompanying drawings and the detailed description below.

Unless defined otherwise, technical or scientific terms used herein shall have the ordinary meaning as understood by one of ordinary skill in the art to which the present disclosure belongs. The use of "first", "second" and the like in the present disclosure is not intended to indicate any order, quantity, or importance, but rather is used to distinguish one element from another. Also, the use of the terms "a", "an" or "the" and similar referents do not denote a limitation of quantity, but rather denote the presence of at least one. The word "include" or "comprise" and the like means that the element or item preceding the word contains the element or item listed after the word and its equivalent, but does not exclude other elements or items. The terms "coupled" or "connected" and the like are not restricted to physical or mechanical connections, but may include electrical connections, whether direct or indirect. The positional relations in the present disclosure only indicate relative positional relationships, and when an absolute position of an object being described is changed, the relative positional relationships may be changed accordingly.

Figure 1:
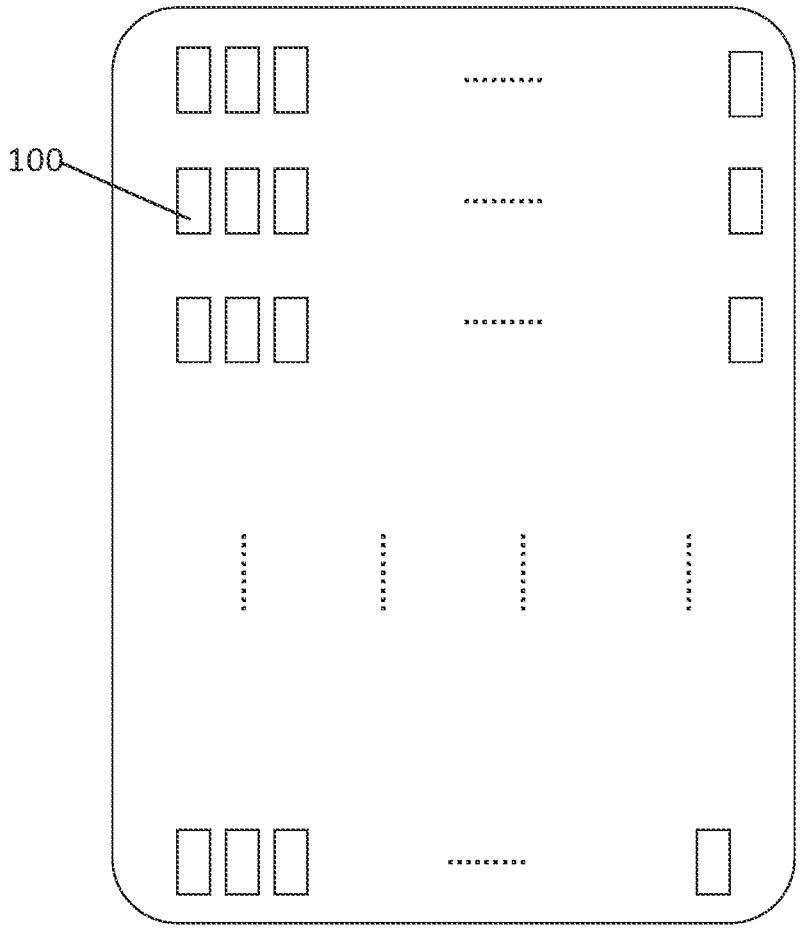
FIG. 1 is a schematic diagram of an exemplary structure of a display substrate.
Figure 2:
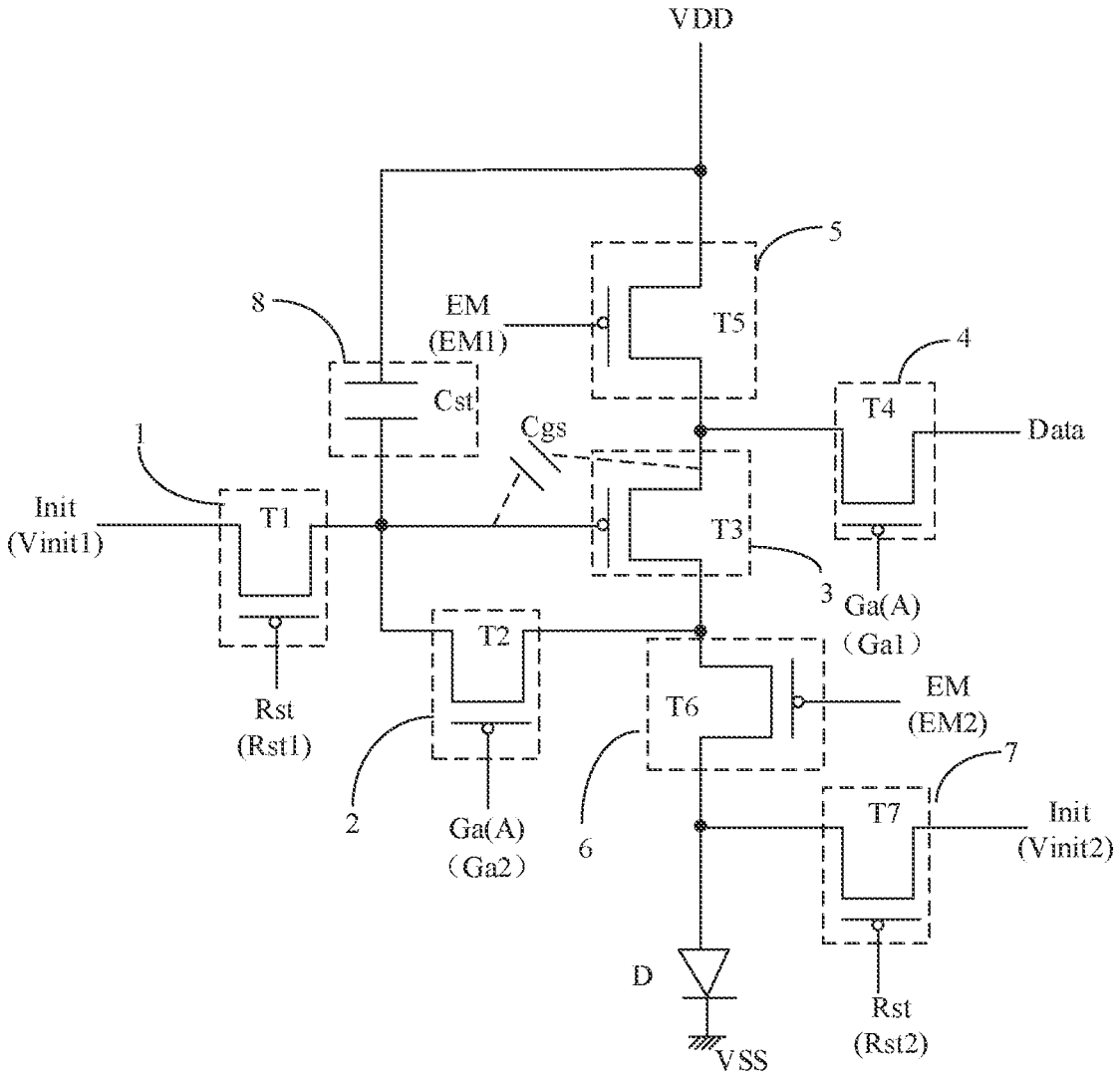
FIG. 2 is a schematic diagram of an exemplary pixel driving circuit.

FIG. 1 is a schematic diagram of an exemplary structure of a display substrate; FIG. 2 is a schematic diagram of an exemplary pixel driving circuit; as shown in FIGS. 1 and 2, the display substrate includes a plurality of pixel units arranged in an array, and each pixel unit 100 includes a pixel driving circuit and a light emitting device D therein. The pixel driving circuit in each pixel unit 100 may include: a first reset sub-circuit 1, a threshold compensation sub-circuit 2, a driving sub-circuit 3, a data writing sub-circuit 4, a first light emitting control sub-circuit 5, a second light emitting control sub-circuit 6, a second reset sub-circuit 7, and a storage sub-circuit 8.

The first reset sub-circuit 1 is coupled to a control terminal of the driving sub-circuit 3 and is configured to reset the control terminal of the driving sub-circuit 3 under control of a first reset signal. The threshold compensation sub-circuit 2 is electrically coupled to the control terminal and a second terminal of the driving sub-circuit 3, respectively, and is configured to perform threshold compensation on the driving sub-circuit 3. The data writing sub-circuit 4 is electrically coupled to a first terminal of the driving sub-circuit 3 and is configured to write a data signal into the storage sub-circuit 8 under control of a scanning signal. The storage sub-circuit 8 is electrically coupled to the control terminal of the driving sub-circuit 3 and a first power supply voltage line VDD, respectively, and is configured to store the data signal. The first light emitting control sub-circuit 5 is coupled to the first supply voltage line VDD and the first terminal of the driving sub-circuit 3, respectively, and is configured to allow a current between the driving sub-circuit 3 and the first supply voltage line VDD or not, and the second light emitting control sub-circuit 6 is electrically coupled to the second terminal of the driving sub-circuit 3 and a first electrode of the light emitting device D, respectively, and is configured to allow a current between the driving sub-circuit 3 and the light emitting device D or not. The second reset sub-circuit 7 is electrically coupled to the first electrode of the light emitting device D and configured to reset the control terminal of the driving sub-circuit 3 and the first electrode of the light emitting device D under control of a second reset control signal.

With continued reference to FIG. 2, the first reset sub-circuit 1 includes a first reset transistor T1, the threshold compensation sub-circuit 2 includes a threshold compensation transistor T2, the driving sub-circuit 3 includes a driving transistor T3, the control terminal of the driving sub-circuit 3 includes a control electrode of the driving transistor T3, the first terminal of the driving sub-circuit 3 includes a first electrode of the driving transistor T3, and the second terminal of the driving sub-circuit 3 includes a second electrode of the driving transistor T3. The data writing sub-circuit 4 includes a data writing transistor T4, the storage sub-circuit 7 includes a storage capacitor Cst, the first light emitting control sub-circuit 5 includes a first light emitting control transistor T5, the second light emitting control sub-circuit 6 includes a second light emitting control transistor T6, and the second reset sub-circuit 7 includes a second reset transistor 17.

It should be noted that, according to characteristics of transistors, the transistors may be divided into N-type transistors and P-type transistors, and for the sake of clarity, embodiments of the present disclosure take transistors being P-type transistors (for example, P-type MOS transistors) as an example to illustrate the technical solutions of the present disclosure in detail, that is, in the description of the present disclosure, the driving transistor T3, the data writing transistor T4, the threshold compensation transistor T2, the first light emitting control transistor T5, the second light emitting control transistor T6, the first reset transistor T1, the second reset transistor T7, and the like may all be P-type transistors. However, the transistors in the embodiments of the present disclosure are not limited to P-type transistors, and one skilled in the art may also implement functions of one or more transistors in the embodiments of the present disclosure by using N-type transistors (e.g., N-type MOS transistors) according to actual needs.

In addition, the transistors used in the embodiments of the present disclosure may be thin film transistors or field effect transistors or other switching devices having the same characteristics, and the thin film transistors may include oxide semiconductor thin film transistors, amorphous silicon thin film transistors or polysilicon thin film transistors, and the like. Each transistor includes a first electrode, a second electrode and a control electrode; the control electrode is used as a gate electrode of the transistor, one of the first electrode and the second electrode is used as a source electrode of the transistor, and the other one is used as a drain electrode of the transistor; the source electrode and the drain electrode of the transistor may be symmetrical in structure, so that there may be no difference in physical structure therebetween. In the embodiments of the present disclosure, in order to distinguish transistors, in addition to the gate electrode serving as the control electrode, the first electrode is directly described as the source electrode, and the second electrode is the drain electrode, but the source electrode and the drain electrode of all or a portion of the transistors in the embodiments of the present disclosure may be interchanged as necessary.

With continued reference to FIG. 2, a drain electrode of the data writing transistor T4 is electrically coupled to a source electrode of the driving transistor T3, a source electrode of the data writing transistor T4 is configured to be electrically coupled to a data line Data to receive a data signal, and a gate electrode of the data writing transistor T4 is configured to be electrically coupled to a first scanning signal line Ga1 to receive a scanning signal; a second electrode of the storage capacitor Cst is electrically coupled to a first power supply voltage line VDD, and a first electrode of the storage capacitor Cst is electrically coupled to a gate electrode of the driving transistor T3; a source electrode of the threshold compensation transistor T2 is electrically coupled to the gate electrode of the driving transistor T3, a drain electrode of the threshold compensation transistor T2 is electrically coupled to a drain electrode of the driving transistor T3, and a gate electrode of the threshold compensation transistor T2 is configured to be electrically coupled to a second scanning signal line Ga2 to receive a compensation control signal; a source electrode of the first reset transistor T1 is configured to be electrically coupled to a first reset power supply terminal Vinit1 to receive a first reset signal, a drain electrode of the first reset transistor T1 is electrically coupled to the gate electrode of the driving transistor T3, and a gate electrode of the first reset transistor T1 is configured to be electrically coupled to a first reset control signal line Rst1 to receive a first reset control signal; a drain electrode of the second reset transistor T7 is configured to be electrically coupled to the first reset power supply terminal Vinit1 to receive the first reset signal, a source electrode of the second reset transistor T7 is electrically coupled to the first electrode of the light emitting device D, and a gate electrode of the second reset transistor 17 is configured to be electrically coupled to a second reset control signal line Rst2 to receive a second reset control signal; a source electrode of the first light emitting control transistor T5 is electrically coupled to the first power supply voltage line VDD, a drain electrode of the first light emitting control transistor T5 is electrically coupled to the source electrode of the driving transistor T3, and a gate electrode of the first light emitting control transistor 15 is configured to be electrically coupled to a first light emitting controlling signal line EM1 to receive a first light emitting controlling signal; a source electrode of the second light emitting control transistor T6 is electrically coupled to the drain electrode of the driving transistor T3, a drain electrode of the second light emitting control transistor T6 is electrically coupled to the first electrode D1 of the light emitting device D, and a gate electrode of the second light emitting control transistor T6 is configured to be electrically coupled to a second light emitting control signal line EM2 to receive a second light emitting control signal; a second electrode of the light emitting device D is electrically coupled to a second power supply terminal VSS.

Figure 8:
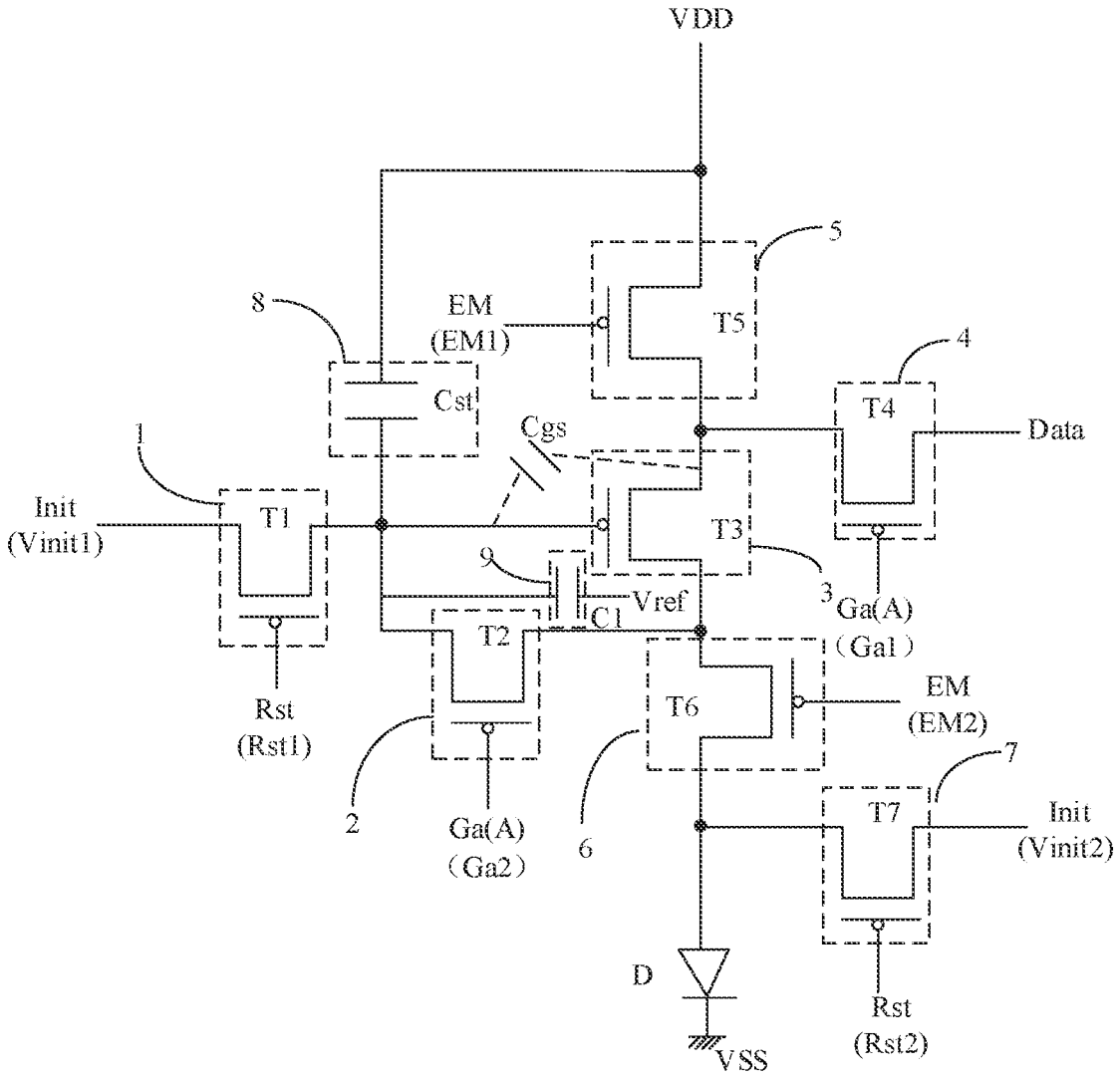
FIG. 8 is another schematic diagram of a pixel driving circuit according to an embodiment of the present disclosure.

For example, one of the first power supply voltage line VDD and the second power supply terminal VSS is a high voltage terminal, and the other is a low voltage terminal. For example, as shown in the embodiment of FIG. 8, the first power supply voltage line VDD is a voltage source to output a constant first voltage, which is a positive voltage; and the second power supply terminal VSS may be a voltage source to output a constant second voltage, which is a negative voltage, or the like. For example, in some examples, the second power supply terminal VSS may be grounded.

With continued reference to FIG. 2, the scanning signal and the compensation control signal may be the same, i.e., the gate electrode of the data writing transistor T4 and the gate electrode of the threshold compensation transistor T2 may be electrically coupled to the same signal line, e.g., the first scanning signal line Ga1, to receive the same signal (e.g., scanning signal), and in such case, the display substrate may not be provided with the second scanning signal line Ga2, reducing the number of signal lines. For another example, the gate electrode of the data writing transistor T4 and the gate electrode of the threshold compensating transistor T2 may be electrically coupled to different signal lines, i.e., the gate electrode of the data writing transistor T4 is electrically coupled to the first scanning signal line Ga1, the gate electrode of the threshold compensating transistor T2 is electrically coupled to the second scanning signal line Ga2, and signals transmitted by the first scanning signal line Ga1 and the second scanning signal line Ga2 are the same.

It should be noted that the scanning signal and the compensation control signal may not be the same, so that gate electrodes of the data writing transistor T4 and the threshold compensation transistor T2 may be separately controlled, thereby increasing flexibility of controlling of the pixel driving circuit. In the embodiment of the present disclosure, a case where the gate electrode of the data writing transistor 14 and the gate electrode of the threshold compensating transistor T2 being electrically coupled to the first scanning line Ga(A) is taken as an example for explanation.

With continued reference to FIG. 2, the first light emitting control signal and the second light emitting control signal may be the same, i.e., the gate electrode of the first light emitting control transistor 15 and the gate electrode of the second light emitting control transistor T6 may be electrically coupled to the same signal line, e.g., the first light emitting control signal line EM1, to receive the same signal (e.g., the first light emitting control signal), and in such case, the display substrate may not be provided with the second light emitting control signal line EM2, reducing the number of signal lines. For another example, the gate electrode of the first light emitting control transistor T5 and the gate electrode of the second light emitting control transistor T6 may be electrically coupled to different signal lines, respectively, that is, the gate electrode of the first light emitting control transistor T5 is electrically coupled to the first light emitting control signal line EM1, the gate electrode of the second light emitting control transistor T6 is electrically coupled to the second light emitting control signal line EM2, and signals transmitted by the first light emitting control signal line EM1 and the second light emitting control signal line EM2 are the same.

It should be noted that, when the first light emitting control transistor T5 and the second light emitting control transistor T6 are different types of transistors, for example, the first light emitting control transistor T5 is a P-type transistor, and the second light emitting control transistor T6 is an N-type transistor, the first light emitting control signal and the second light emitting control signal may also be different, which is not limited in the embodiment of the disclosure. In the embodiment of the present disclosure, a case where gate electrodes of the first light emitting control transistor T5 and the second light emitting control transistor T6 are both coupled to the light emitting control line EM is taken as an example for explanation.

For example, the first reset control signal and the second reset control signal may be the same, that is, the gate electrode of the first reset transistor T1 and the gate electrode of the second reset transistor T7 may be electrically coupled to the same signal line, for example, the first reset control signal line Rst1, to receive the same signal (for example, the first reset control signal), and in such case, the display substrate may not be provided with the second reset control signal line Rst2, reducing the number of signal lines. For another example, the gate electrode of the first reset transistor T1 and the gate electrode of the second reset transistor T7 may be electrically coupled to different signal lines, respectively, that is, the gate electrode of the first reset transistor T1 is electrically coupled to the first reset control signal line Rst1, the gate electrode of the second reset transistor T7 is electrically coupled to the second reset control signal line Rst2, and signals transmitted by the first reset control signal line Rst1 and the second reset control signal line Rst2 are the same. It should be noted that the first reset control signal and the second reset control signal may be different. It is exemplified in the embodiment of the present disclosure that the gate electrode of the first reset transistor T1 and the gate electrode of the second reset transistor T7 are both electrically coupled to the reset control signal line Rst.

For example, in some examples, the second reset control signal may be the same as the scanning signal, i.e., the gate electrode of the second reset transistor T7 may be electrically coupled to the scanning signal line Ga(A) to receive the scanning signal as the second reset control signal.

For example, the source electrode of the first reset transistor T1 and the drain electrode of the second reset transistor T7 are coupled to the first reset power supply terminal and the second reset power supply terminal Vinit2, respectively, and the first reset power supply terminal Vinit1 and the second reset power supply terminal Vinit2 may be direct current reference voltage terminals to output a constant direct current reference voltage. The first reset power supply terminal Vinit1 and the second reset power supply terminal Vinit2 may be the same, for example, the source electrode of the first reset transistor T1 and the drain electrode of the second reset transistor T7 are coupled to the same reset power supply terminal. The first reset power supply terminals Vinit1 and the second reset power supply terminal Vinit2 may be high voltage terminals or low voltage terminals, as long as they can provide a first reset signal and a second reset signal to reset the gate electrode of the driving transistor T3 and the first electrode D1 of the light emitting element D, which is not limited by the present disclosure. For example, the source electrode of the first reset transistor T1 and the drain electrode of the second reset transistor T7 may both be coupled to a reset power signal line Init.

It should be noted that, in the embodiment of the present disclosure, the gate electrode of the first reset transistor T1 and the gate electrode of the second reset transistor T7 are both electrically coupled to Rst1; the source electrode of the first reset transistor T1 and the drain electrode of the second reset transistor T7 are both electrically coupled to the reset power signal line Init. In addition, the driving sub-circuit, the data writing sub-circuit, the storage sub-circuit, the threshold compensation sub-circuit, and the reset sub-circuit in the pixel driving circuit shown in FIG. 2 are only schematic, and specific structures of the sub-circuits such as the driving sub-circuit, the data writing sub-circuit, the storage sub-circuit, the threshold compensation sub-circuit, and the reset sub-circuit may be set according to practical application requirements, which is not specifically limited by the embodiment of the present disclosure.

It should be noted that, in the embodiment of the present disclosure, in addition to the 7T1C (i.e., including seven transistors and one capacitor) structure shown in FIG. 2, the pixel driving circuit of the sub-pixel may also be in a circuit structure including another number of transistors and capacitors, such as may be in a 7T2C structure, a 6T1C structure, a 6T2C structure, or a 9T2C structure, which is not limited in the embodiment of the present disclosure.

The light emitting device D may be a micro inorganic light emitting diode, further, may be an electric current type light emitting diode, such as a micro light emitting diode (Micro LED) or a mini light emitting diode (Mini LED), and certainly, the light emitting device D in the embodiment of the present disclosure may also be an organic light emitting diode (OLED). One of the first electrode and the second electrode of the light emitting device D is an anode, and the other is a cathode; in the embodiment of the present disclosure, a case where the first electrode of the light emitting device D is the anode and the second electrode of the light emitting device D is the cathode is taken as example for explanation.

Figure 3:
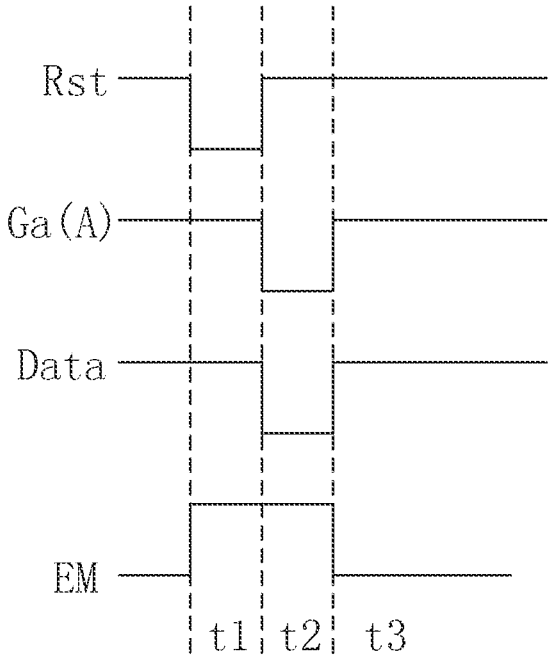
FIG. 3 is a timing diagram illustrating operations of the pixel driving circuit shown in FIG. 2.

FIG. 3 is a timing diagram illustrating operations of the pixel driving circuit shown in FIG. 2; as shown in FIGS. 2 and 3, the driving method of the pixel driving circuit described above may include following stages t1 to t3.

In a reset stage (t1), a low level signal is written into the reset control signal line Rst, and a high level signal is written into the scanning line Ga(A) and the light emitting control line EM; the first reset transistor T1 and the second reset transistor T7 are turned on, and the gate electrode of the driving transistor T3 is reset by the initial voltage Vinit written by the reset power signal line Init, preparing for writing a data voltage Vdata in the next frame. An initialization voltage (Vinit, being less than or equal to VSS) is written into the anode of the light emitting device D through the second reset transistor T7, so that the light emitting device D is no longer in a forward conduction state, and an internal electric field formed by directional movement of impurity ions in the light emitting device D gradually disappears, thereby recovering characteristics of the light emitting device D.

In a data writing and threshold compensation stage (t2), a low level signal is written into the scanning line Ga(A), and a high level signal is written into the reset control signal line Rst and the first light emitting control line EM; the data writing transistor T4 and the threshold compensation transistor T2 are turned on. The driving transistor T3 is connected into a diode structure by the threshold compensation transistor T2, and the data voltage Vdata written into the data line Data is written into the gate electrode of the driving transistor T3 through the data writing transistor T4 and the threshold compensation transistor T2, until the driving transistor T3 is turned off. The gate voltage of the driving transistor T3 is Vdata+Vth (Vth<0, Vth being a threshold voltage of the driving transistor T3), and is stored in the storage capacitor Cst. Voltages of the first electrode and the second electrode of the storage capacitor Cst are Vdata+Vth and Vd, respectively.

In a light emitting stage (t3), a low level signal is written into the light emitting control line EM, a high level signal is written into the scanning line Ga(A) and the reset control signal line Rst, the first light emitting control transistor T5 and the second light emitting control transistor T6 are both turned on, the source electrode of the driving transistor T3 is coupled to the first power supply voltage line VDD, and the source voltage of the driving transistor T3 is instantaneously changed from Vdata in the previous stage to Vdd. The light emitting device D emits light under the driving of the driving transistor T3, and at this time, the driving transistor T3 works in a saturation region, the gate voltage of the driving transistor T3 is Vdata+Vth, and the source voltage of the driving transistor T3 is Vdd, and thus a gate-source voltage of the driving transistor T3 is vgs=(Vdata+Vth)−Vdd, until the reset stage of the next frame.

The light emitting current of the light emitting device D is equal to the current flowing through the driving transistor T3, which is expressed as follows:

$$\begin{aligned} I_D &= \beta(Vgs - Vth)^2 \\ &= \beta(Vdata + Vth - Vdd - Vth)^2 \\ &= (Vdata - Vdd)^2. \end{aligned} \tag{1}$$

Here, $$\beta = \frac{1}{2}\mu_n C_{ox}\left(\frac{W}{L}\right),$$

$\mu_n$ is an electron mobility of the driving transistor T3, $C_{ox}$ is an insulation capacitance per unit area, and $$\frac{W}{L}$$

is a width-to-length ratio of the driving transistor T3.

Figure 4:
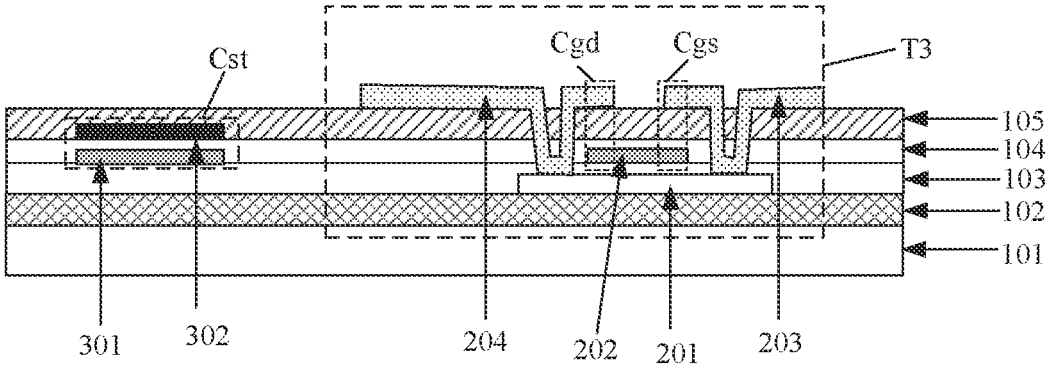
FIG. 4 is a cross-sectional view of a driving transistor and a storage capacitor in the pixel driving circuit shown in FIG. 2.
Figure 5:
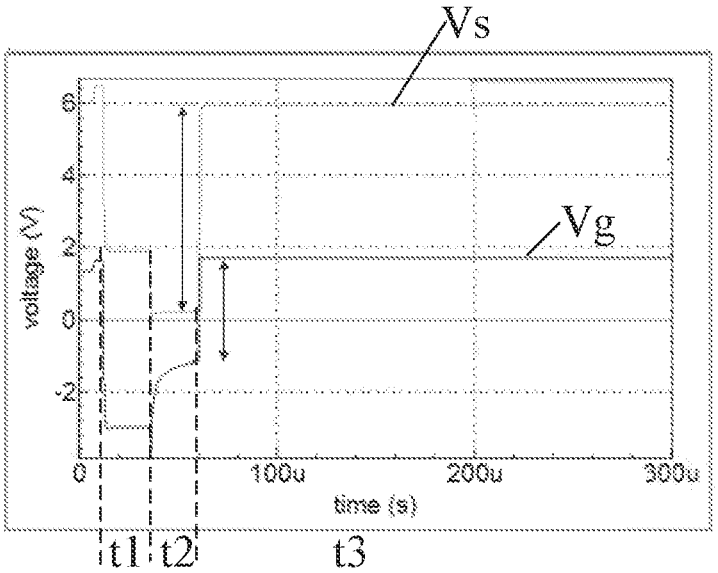
FIG. 5 is a simulation diagram of changes of a source voltage Vs and a gate voltage Vg of a driving transistor in each operation stage of the pixel driving circuit shown in FIG. 2.
Figure 6:
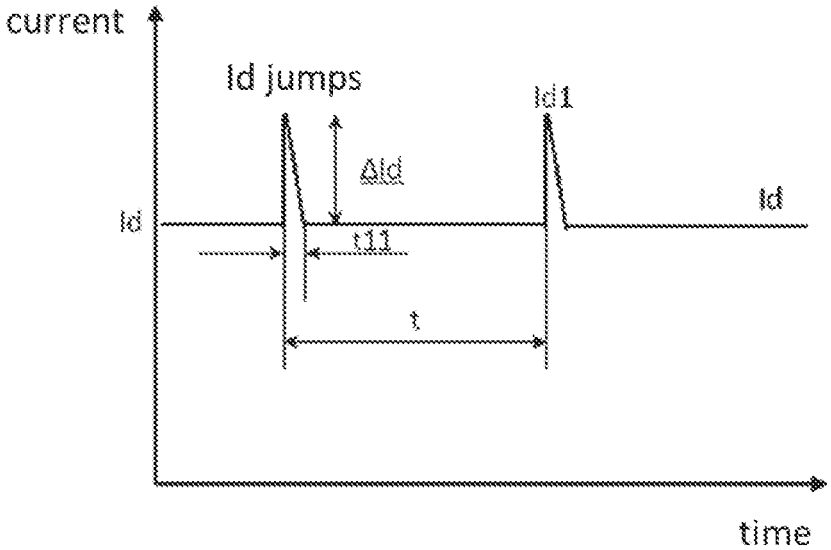
FIG. 6 is a diagram illustrating a corresponding relationship between a driving current generated by the pixel driving circuit of FIG. 2 and time.

FIG. 4 is a cross-sectional view of a driving transistor and a storage capacitor in the pixel driving circuit shown in FIG. 2; as shown in FIG. 4, the driving transistor T3 is a top gate thin film transistor, a buffer layer 102 is formed on a substrate 101, an active layer 201 of the driving transistor is formed on a side of the buffer layer 102 away from the substrate 101, a first gate insulating layer 103 is formed on a side of the active layer 201 of the driving transistor away from the substrate 101, a gate electrode 202 of the driving transistor and a first electrode 301 of the storage capacitor Cst are formed on a side of the buffer layer 102 away from the substrate 101, and a second gate insulating layer 104 is formed on a side of the gate electrode 202 of the driving transistor away from the substrate 101; a second electrode 302 of the storage capacitor Cst is formed on a side of the second gate insulating layer 104 away from the substrate 101; an interlayer insulating layer 105 is formed on a side of the second electrode 302 of the storage capacitor Cst away from the substrate, and a source electrode 203 and a drain electrode 204 of the driving transistor T3 are formed on a side of the interlayer insulating layer 105 away from the substrate 101. It is found that, when a micro inorganic light emitting diode is used as the light emitting device, the driving current of the pixel driving circuit needs to be in the order of μA or mA, and in such case, in order that the driving transistor T3 in the pixel driving circuit generates a stable output current, the driving transistor T3 needs to have a relative large channel width and a relative large channel length, and as the channel width and the channel length increase, a coupling capacitance Cgs formed by the gate electrode 202 and the source electrode 203 of the driving transistor T3 and a coupling capacitance Cgd formed by the gate electrode 202 and the drain electrode 204 of the driving transistor T3 increase. FIG. 5 is a simulation diagram of changes in the source voltage Vs and the gate voltage Vg of the driving transistor in each operation stage of the pixel driving circuit shown in FIG. 2. As shown in FIG. 5, when Cgs is increased, once the voltage Vs at the source electrode of the driving transistor T3 changes significantly (e.g., Vdata in the data writing and threshold compensation stage t2 goes to Vdd in the light emitting stage t3), due to voltage holding effect of Cgs, the gate voltage Vg of the driving transistor T3 will change along with the voltage Vs at the source electrode, resulting in a decrease in the gate-source voltage Vgs of the driving transistor T3, and further a decrease in the output current generated by the driving transistor T3, and a decrease in the light emitting brightness of the light emitting device. In order to avoid the above problems, one solution is to increase the storage capacitor Cst, but after the storage capacitor Cst is increased, since the second electrode 302 of the storage capacitor Cst is coupled to the first power supply voltage line VDD, the data line Data and the first power supply voltage line VDD are adjacent and arranged side by side and a certain coupling capacitance exists therebetween, when the voltage of the data line Data jumps, the voltage of the first power supply voltage line VDD jumps due to capacitance coupling, and since the storage capacitor Cst is relative large, under bootstrap action of the storage capacitor Cst, the gate voltage of the driving transistor T3 jumps, which further causes the current Id to change (e.g. the Id jumps ΔId at time T11 in FIG. 6), therefore the increase of the storage capacitor Cst needs to take into account the influence of jump of voltage of the first power supply voltage line VDD, that is, there is an upper limit for the increase of Cst.

In view of the above technical problems, the following technical solutions are provided in the embodiments of the present disclosure.

Figure 7:
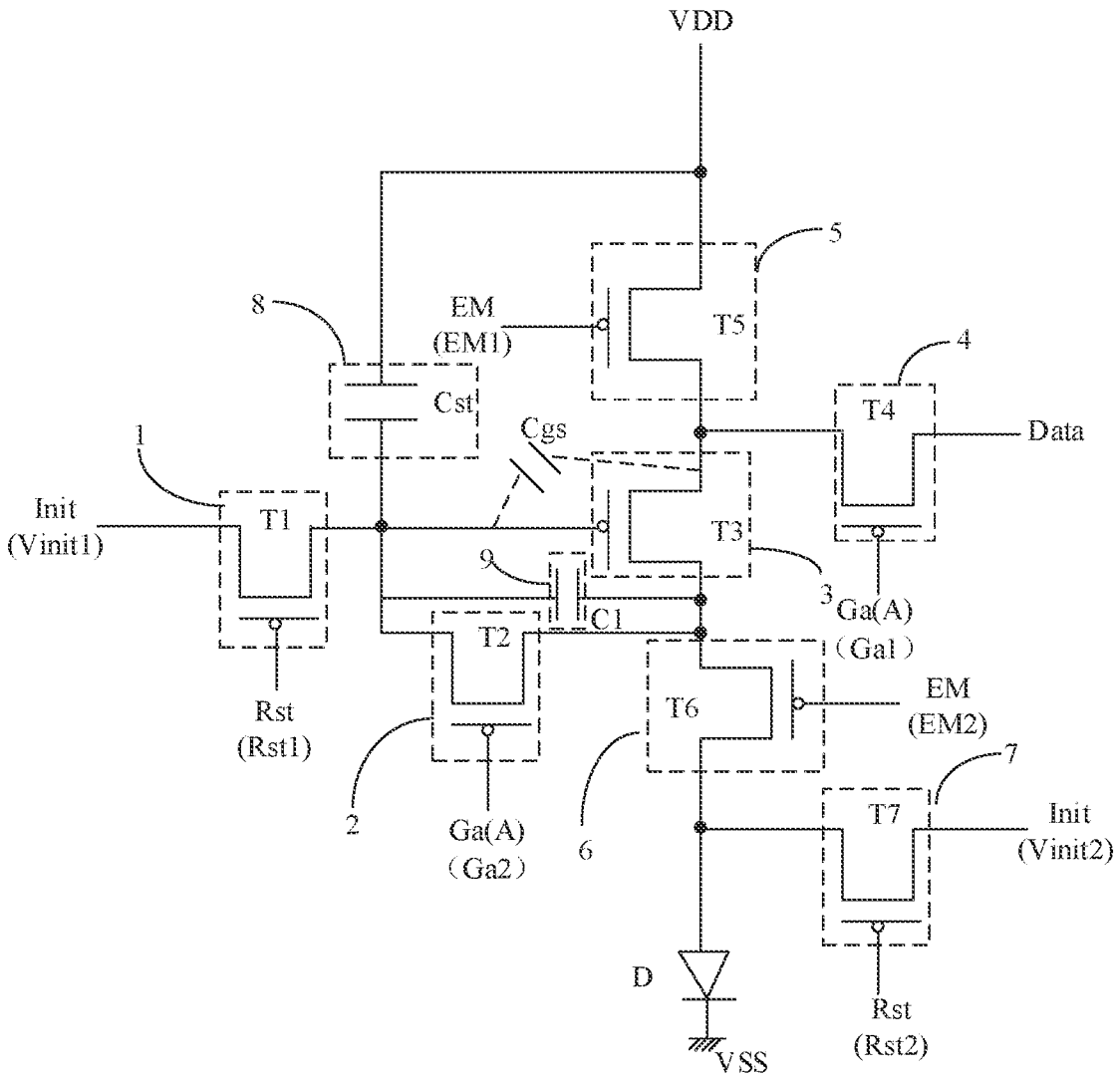
FIG. 7 is a schematic diagram of a pixel driving circuit according to an embodiment of the present disclosure.

In a first aspect, FIG. 7 is a schematic diagram of a pixel driving circuit according to an embodiment of the present disclosure; as shown in FIG. 7, the present disclosure provides a pixel driving circuit, which may include the data writing sub-circuit 4, the threshold compensation sub-circuit 2, the driving sub-circuit 3, and the storage sub-circuit 8, and in particular, the pixel driving circuit further includes a voltage maintaining sub-circuit 9. The voltage maintaining sub-circuit 9 is electrically coupled to the first terminal of the driving sub-circuit 3, and is configured to maintain the voltage of control terminal of the driving sub-circuit 3 when the voltage of the first terminal of the driving sub-circuit 3 jumps.

In some implementations, the driving sub-circuit 3 may include the driving transistor T3, the source electrode of the driving transistor T3 serves as the first terminal of the driving sub-circuit 3, the drain electrode of the driving transistor T3 serves as the second terminal of the driving sub-circuit 3, and the gate electrode of the driving transistor T3 serves as the control terminal of the driving sub-circuit 3. The voltage maintaining sub-circuit 9 in the embodiment of the present disclosure is configured to maintain the voltage of the control terminal of the driving sub-circuit 3, that is, the voltage of the gate electrode of the driving transistor T3. The description is made in the embodiment of the present disclosure by taking a case where the driving sub-circuit 3 includes the driving transistor T3 as an example.

Specifically, the data writing sub-circuit 4 and the threshold compensation sub-circuit 2 operate under control of the scanning signal in the data writing and threshold compensation stage, and at this time, the gate electrode and the drain electrode of the driving transistor T3 are connected by the threshold compensation sub-circuit 2, and the source electrode of the driving transistor T3 is written with the data voltage signal Vdata, and the gate voltage of the driving transistor T3 is Vdata+Vth (Vth<0, Vth is the threshold voltage of the driving transistor T3). In the light emitting stage, the voltage of the source electrode of the driving transistor T3 changes to the first voltage Vdd, that is, the voltage of the source electrode of the driving transistor T3 jumps from Vdata to Vdd from the data writing and threshold compensation stage to the light emitting stage, and a large transient change occurs, and in the embodiment of the present disclosure, by providing the voltage maintaining sub-circuit 9, the voltage of the gate electrode of the driving electrode transistor does not change significantly when the voltage of the source electrode of the driving electrode transistor changes significantly instantaneously, and thus the current that the driving transistor T3 can output in the light emitting stage is stable, and the light emitting device D to be driven can be ensured to emit light normally.

In some implementations, the voltage maintaining sub-circuit 9 includes a first capacitor C1, a first electrode of the first capacitor C1 is coupled to the gate electrode of the driving transistor T3, and is configured to maintain the voltage of the gate electrode of the driving transistor T3 when the voltage of the source electrode of the driving transistor T3 jumps. In the embodiment of the present disclosure, the first capacitor C1 maintains the voltage of the gate electrode of the driving transistor T3 to be stable, so that the light emitting device D can be ensured to emit light normally in a display stage, and compared with the related art in which the voltage of the gate electrode of the driving transistor T3 is maintained to be stable by increasing the capacitance of the storage capacitor Cst, the size of the storage capacitor Cst can be reduced (an area of two electrodes of the storage capacitor Cst is reduced) by adding the first capacitor C1, so that an area of the pixel driving circuit can be reduced, thereby improving resolution of a display panel to which the pixel driving circuit is applied, and at the same time, the problem, that the capacitance of the first power supply voltage line VDD increases after the capacitance of the storage capacitor Cst is increased and the current changes because the voltage of VDD jumps due to capacitance coupling when the voltage of the data line Data jumps, can be avoided.

In an example, with continued reference to FIG. 7, a first electrode of the first capacitor C1 is coupled to the gate electrode of the driving transistor T3, and a second electrode of the first capacitor C1 is coupled to the drain electrode of the driving transistor T3. This is so because, during the data writing and threshold compensation stage, the voltage of the drain electrode of the driving transistor T3 is Vdata+Vth, and during the light emitting stage, the voltage of the drain electrode of the driving transistor T3 is Vdd+Vds, where Vds represents the voltage across the source electrode and the drain electrode of the driving transistor T3 being turned on, the value of Vdata depends on a gray scale value to be displayed by the light emitting device D, and the voltage value of Vds depends on a driving current corresponding to the gray scale value to be displayed by the light emitting device D. In some implementations, Vds ranges from about −3V to about −5V, Vth ranges from about −0.7V to about −1.3V, and a maximum voltage difference between Vdd and Vdata is no more than 5V. Therefore, (Vdd+Vds)−(Vdata+Vth) is about 1V, and thus, under bootstrap action of the first capacitor C1, the voltage of the drain electrode of the driving transistor T3 changes relatively little from the data writing and threshold compensation stage to the light emitting stage, and therefore, under the action of the first capacitor C1, the voltage of the gate electrode of the driving transistor T3 would not change significantly, so that the voltage of the gate electrode of the driving transistor T3 can be effectively maintained, the stability of the driving transistor T3 in the light emitting stage is ensured, and the light emitting device D can emit light normally.

It should be noted that, in the embodiment of the present disclosure, the first electrode of the first capacitor C1 is coupled to the gate electrode of the driving transistor T3, and the second electrode of the first capacitor C1 is coupled to the drain electrode of the driving transistor T3, and at this time, the first electrode of the first capacitor C1 may be formed at the same time as the gate electrode of the driving transistor T3 being formed, and the second electrode of the first capacitor C1 may be formed at the same time as the drain electrode of the driving transistor T3 being formed. Thus, a thickness of the display panel using the pixel driving circuit is not increased, and the number of process steps is also not increased. Certainly, the first electrode and the second electrode of the first capacitor C1 may be formed by two separate metal layers.

In another example, FIG. 8 is another schematic diagram of a pixel driving circuit according to an embodiment of the present disclosure; as shown in FIG. 8, different from the pixel driving circuit shown in FIG. 7, the first electrode of the first capacitor C1 is coupled to the gate electrode of the driving transistor T3, and the second electrode of the first capacitor C1 is coupled to a reference voltage terminal Vref. For example, the reference voltage terminal Vref is continuously written with a fixed reference voltage, that is, the potential of the second electrode of the first capacitor C1 keeps at the reference voltage at any stage, so that even though the voltage of the gate electrode of the driving transistor T3 is changed significantly and instantaneously from the data writing and threshold compensation stage to the light emitting stage, the voltage of the gate electrode of the driving transistor T3 can be kept unchanged by the first capacitor C1, so as to avoid the formation of coupling capacitance Cgs between the gate electrode and the source electrode of the driving transistor T3 and thus affecting the voltage of the gate electrode of the driving transistor T3.

It should be noted that, in the following description, the first electrode of the first capacitor C1 is coupled to the gate electrode of the driving transistor T3, and the second electrode of the first capacitor C1 is coupled to the drain electrode of the driving transistor T3, which is not intended to limit the scope of the embodiments of the present disclosure.

For example, with continued reference to FIG. 7, in the pixel driving circuit according to the embodiment of the present disclosure, not only the data writing sub-circuit 4, the threshold compensation sub-circuit 2, the driving sub-circuit 3, the storage sub-circuit 8, and the first capacitor C1 described above are included, but also at least one of the first reset sub-circuit 1, the second reset sub-circuit 7, the first light emitting control sub-circuit 5, and the second light emitting control sub-circuit 6 may be included. A case where the pixel driving circuit includes the first reset sub-circuit 1, the second reset sub-circuit 7, the first light emitting control sub-circuit 5, and the second light emitting control sub-circuit 6 will be taken as an example for explanation. The data writing sub-circuit 4, the threshold compensation sub-circuit 2, the driving sub-circuit 3 the storage sub-circuit 8, the first reset sub-circuit 1, the second reset sub-circuit 7, the first light emitting control sub-circuit 5, and the second light emitting control sub-circuit 6 may be the same as those shown in FIG. 2, and therefore, the description thereof is not repeated here. As for the first electrode of the first capacitor C1 coupled to the gate electrode of the driving transistor T3 and the drain electrode of the threshold compensation transistor T2, the second electrode of the first capacitor C1 is coupled to the drain electrode of the driving transistor T3 and the source electrode of the threshold compensation transistor T2. The following describes a driving method of the pixel driving circuit according to the embodiment of the present disclosure, so as to clearly understand functions of each part of the pixel driving circuit according to the embodiment of the present disclosure.

Also referring to the timing chart shown in FIG. 3; as shown in FIGS. 3 and 7, the driving method of the pixel driving circuit of the embodiment of the present disclosure includes the following stages t1 to t3.

In the reset stage (t1), the reset control signal line Rst is written with a low level signal, and the scanning line Ga(A) and the light emitting control line EM is written with a high level signal; the first reset transistor T1 and the second reset transistor T7 are turned on, and the gate electrode of the driving transistor T3 is reset by the initial voltage Vinit written by the reset power supply signal line Init, preparing for being written with the data voltage Vdata in the next frame. An initialization voltage (Vinit, being less than or equal to VSS) is written into the anode of the light emitting device D through the second reset transistor T7, so that the light emitting device D is no longer in a forward conduction state, and an internal electric field formed by directional movement of impurity ions in the light emitting device D gradually disappears, thereby recovering the characteristics of the light emitting device D.

In the data writing and threshold compensation stage (t2), a low level signal is written into the scanning line Ga(A), and a high level signal is written into the reset control signal line Rst and the first light emitting control line EM; the data writing transistor T4 and the threshold compensation transistor T2 are turned on. The driving transistor T3 is connected into a diode structure by the threshold compensation transistor T2, and the data voltage written into the data line Data is written to the gate electrode of the driving transistor T3 through the data writing transistor T4 and the threshold compensation transistor T2, until the driving transistor T3 is turned off. The voltage of the gate electrode of the driving transistor T3 is Vdata+Vth (Vth<0, Vth being the threshold voltage of the driving transistor T3), and is stored in the storage capacitor Cst. Voltages of the first electrode and the second electrode of the storage capacitor Cst are Vdata+Vth and Vdd respectively; and both voltages of the first electrode and the second electrode of the first capacitor C1 are Vdata+Vth.

In the light emitting stage (t3), the light emitting control line EM is written with a low level signal, the scanning line Ga(A) and the reset control signal line Rst are written with a high level signal, the first light emitting control transistor T5 and the second light emitting control transistor T6 are both turned on, the source electrode of the driving transistor T3 is coupled to the first power supply voltage line VDD, and the voltage of the source electrode of the driving transistor T3 is instantaneously changed from Vdata in the previous stage to Vdd. The voltage of the drain electrode of the driving transistor T3 is changed from Vdata+Vth in the previous stage to Vdd+Vds, where the value of Vdata depends on the gray scale value to be displayed by the light emitting device D, and Vds is the voltage across the source electrode and the drain electrode of the driving transistor T3, and the voltage value of Vds depends on the driving current corresponding to the gray scale value to be displayed by the light emitting device D. In some implementations, Vds ranges from about −3V to about −5V, Vth ranges from about −0.7V to about −1.3V, and the maximum voltage difference between Vdd and Vdata is not more than 5V, (Vdd+Vds)−(Vdata+Vth) is about 1V, and thus, under bootstrap action of the first capacitor C1, the voltage of the gate electrode of the driving transistor T3 changes only by about 1V with respect to the voltage Vdata+Vth in the previous stage, which is approximately Vdata+Vth, that is, even though there is a relatively large coupling capacitor Cgs between the gate electrode and the source electrode of the driving transistor T3, when there is a large transient change in the voltage of the source electrode of the driving transistor T3, due to the presence of the first capacitor C1, there is no relatively large transient change in the voltage of the gate electrode of the driving transistor T3.

In addition, the light emitting device D emits light under the driving of the driving transistor T3, and at this time, the driving transistor T3 operates in a saturation region, the voltage of the gate electrode of the driving transistor T3 is Vdata+Vth, and the voltage of the source electrode of the driving transistor T3 is Vdd, and thus the gate-source voltage of the driving transistor T3 is Vgs=(Vdata+Vth)−Vdd, until the reset stage of the next frame.

The light emitting current of the light emitting device D is equal to the current flowing through the driving transistor T3, which is expressed as follows:

$$\begin{aligned} I_D &= \beta(Vgs - Vth)^2 \\ &= \beta(Vdata + Vth - Vdd - Vth)^2 \\ &= (Vdata - Vdd)^2. \end{aligned} \tag{1}$$

Here, $$\beta = \frac{1}{2}\mu_n C_{ox}\left(\frac{W}{L}\right),$$

$\mu_n$ is an electron mobility of the driving transistor T3, $C_{ox}$ is an insulation capacitance per unit area, and $$\frac{W}{L}$$

is a width-to-length ratio of the driving transistor T3.

As shown in the above formula (1), the current of the light emitting device D is independent of the threshold voltage of the driving transistor T3 during the light emitting stage, and thus the influence of the threshold voltage of the driving transistor T3 on the display uniformity of the display panel is avoided. In addition, the following tables 1 and 2 show simulation results of the pixel driving circuit in the embodiment of the present disclosure shown in FIG. 7 and the pixel driving circuit in the related art as shown FIG. 2, where Vg denotes the voltage of the gate electrode of the driving transistor T3, and Id denotes the driving current generated during the light emitting stage of the driving transistor T3.

TABLE 1

| Pixel driving circuit | Cst(pF) | C1(pF) | Vg(light emitting stage) | Id(μ A) |
|---|---|---|---|---|
| With reference to FIG. 7 | 1.53 | 1.5 | 0.409 V | 75.5 |
| With reference to FIG. 2 | 3.1 | no | 0.409 V | 75.5 |

TABLE 2

| Pixel driving circuit | Cst(pF) | C1(pF) | Vg(light emitting stage) | Id(μ A) |
|---|---|---|---|---|
| With reference to FIG. 7 | 3.1 | 1.5 | −0.116 V | 98.5 |
| With reference to FIG. 2 | 3.1 | no | 0.409 V | 75.5 |

Specifically, as can be seen from table 1, in the pixel driving circuits shown in FIG. 7 and FIG. 2, in the light emitting stage, the voltages Vg of the gate electrode of the driving transistor T3 are both 0.409V, and when the driving current Id generated by the driving transistor is 75.5 μA, that is, under a same current (luminance) reference, in the pixel driving circuit shown in FIG. 7 of the present disclosure, due to the addition of the first capacitor C1, the storage capacitor Cst may be relatively smaller than that of the pixel driving circuit shown in FIG. 2, and in particular, in the pixel driving circuit shown in FIG. 7, when the capacitance of the storage capacitor C1 is 1.5 pF, the capacitance of the storage capacitor Cst is 1.53 pF, and to achieve the same effect, the storage capacitor Cst with the capacitance of 3.1 pF needs to be selected for the pixel driving circuit shown in FIG. 2. It can be seen that an aperture ratio and a resolution of the display panel to which the pixel driving circuit of the embodiment of the present disclosure is applied are improved.

As can be seen from table 2, when the storage capacitor Cst in the pixel driving circuit shown in FIG. 7 and the storage capacitor Cst in the related art shown in FIG. 2 are the same, since the first capacitor C1 is provided in the pixel driving circuit shown in FIG. 7, the voltage Vg of the gate electrode of the driving transistor T3 in the pixel driving circuit shown in FIG. 7 is influenced by a significantly smaller amount than that in the pixel driving circuit shown in FIG. 2 during the light emitting stage, and the generated driving current of the pixel driving circuit shown in FIG. 7 is significantly greater than that of the pixel driving circuit shown in FIG. 2. For example, in the pixel driving circuit shown in FIG. 7 and the related art shown in FIG. 2, the capacitance of the storage capacitor Cst is 3.1 pF, the capacitance of the first capacitor C1 is 1.5 pF, and during the light emitting stage, the voltage of the gate electrode of the driving transistor T3 of the pixel driving circuit shown in FIG. 7 is −0.116V, and the driving current Id is 98.5; the voltage Vg of the gate electrode of the driving transistor T3 of the pixel driving circuit shown in FIG. 2 is 0.409V, and the driving current Id is 75.5.

Figure 9:
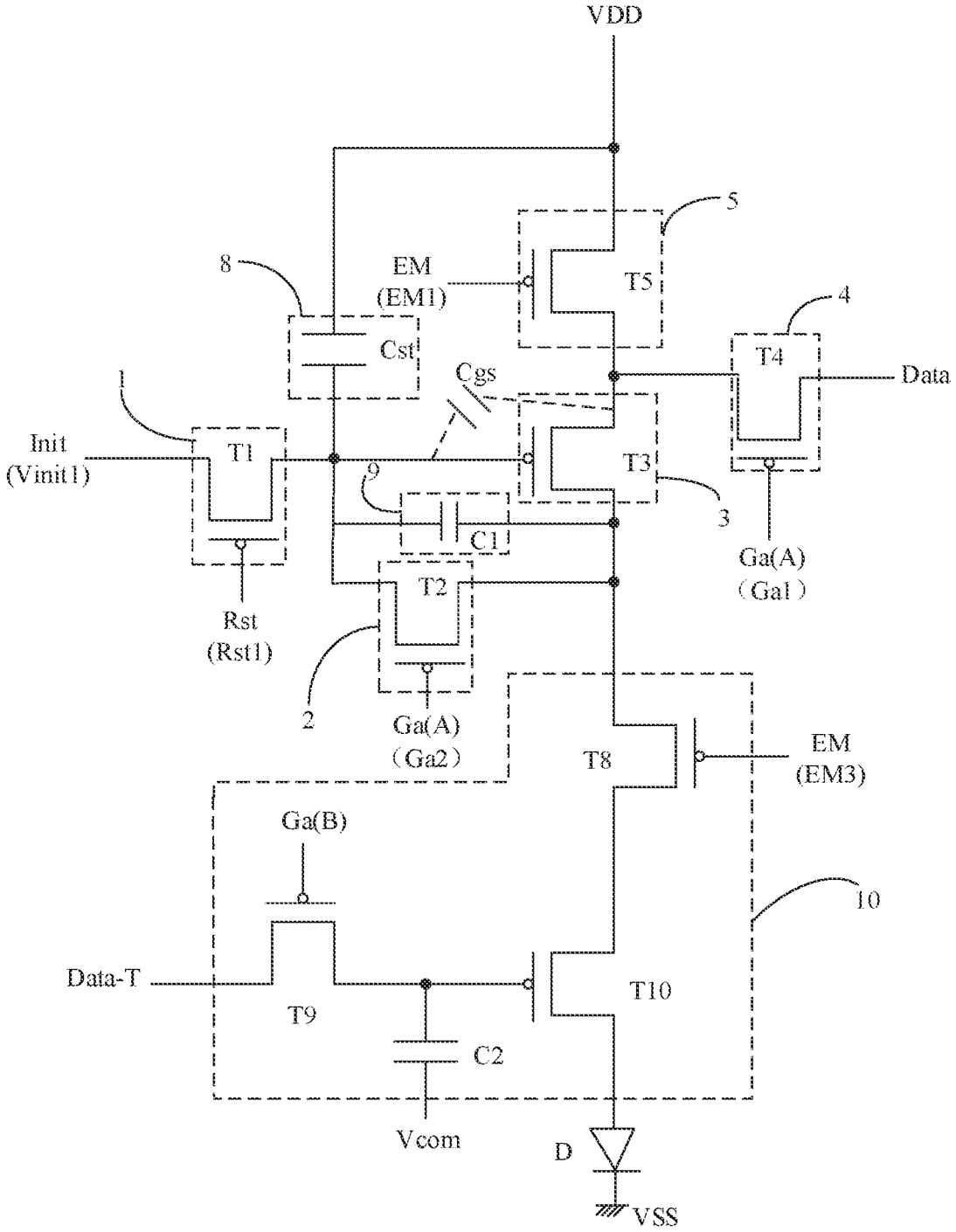
FIG. 9 is further another schematic diagram of a pixel driving circuit according to an embodiment of the present disclosure.

In some implementations, FIG. 9 is further another schematic diagram of a pixel driving circuit according to an embodiment of the present disclosure; as shown in FIG. 9, the pixel driving circuit not only includes the data writing sub-circuit 4, the threshold compensation sub-circuit 2, the driving sub-circuit 3, the storage sub-circuit 8, the first capacitor C1, the first reset sub-circuit 1, and the first light emitting control sub-circuit 5; but also includes a time control sub-circuit configured to control a light emitting time duration of the light emitting device D to be driven by a time modulation signal and a third light emitting control signal in response to a time control signal. Thus, when the driving transistor T3 outputs a constant current, a time duration of the driving circuit writing into the light emitting device D may be adjusted by the time modulation signal and the third light emitting control signal, so as to realize the display of different gray scales.

In an example, with continued reference to FIG. 9, the time control sub-circuit 10 may include a first time modulation transistor T8, a second time modulation transistor T9, a third light emitting control transistor T10, and a second capacitor C2; where, a source electrode of the first time modulation transistor T8 is coupled to the drain electrode of the driving transistor T3, a drain electrode of the first time modulation transistor T8 is coupled to a source electrode of the third light emitting control transistor T10, and a gate electrode of the first time modulation transistor T8 is coupled to a third light emitting control line EM3; a source electrode of the second time modulation transistor T9 is coupled to a time modulation signal terminal Data-T, a drain electrode of the second time modulation transistor T9 is coupled to a gate electrode of the third light emitting control transistor T10, and a gate electrode of the second time modulation transistor T9 is coupled to a time control signal line Ga(B); a drain electrode of the third light emitting control transistor T10 is coupled to the anode of the light emitting device D to be driven, and a gate electrode of the third light emitting control transistor T10 is coupled to a first electrode of the second capacitor C2; a second electrode of the second capacitor C2 is coupled to a common voltage terminal Vcom.

In some implementations, a time duration, during which the third light emitting control line EM3 is written with a low level in the display time of a frame, is controlled, for example, a duty ratio of a signal written into the third light emitting control line EM3, is controlled to control a time duration during which the first time modulation transistor T8 is turned on, thereby controlling a time duration during which the driving transistor T3 outputs the driving current to the light emitting device D.

In an example, the third light emitting control line EM3 is configured to be written with a plurality of low level signals for a plurality of times within the display time of the frame, and time durations of the low level signals which are written are different. For example, the number of times that the third light emitting control line EM3 is written with the low level signals in the display time of the frame is N, N is an integer greater than or equal to 2, the time durations of the low level signals written into the third light emitting control line EM3 in the first to $N^{th}$ scanning periods are represented by $t_1, t_2, \ldots t_n$, respectively, $t_1=T$, $t_2=T/2 \ldots t_N=T/2^{(N-1)}$, that is, $t_{(m-1)}=2t_m$, and m is an integer from 1 to N. In the display time of the frame, a low level signal is written into the time control signal line Ga(B) in each scanning period of the third light emitting control line EM3 for a certain time, and at this time, for each pixel, the relationship between the number p of the low level signals (effective levels) input by the time modulation signal terminal Data-T and the kinds K of light emitting time durations that the pixel can realize is $k=2^p$, and p is more than or equal to 1 and less than or equal to N. The light emitting time duration of each pixel is determined by the number h of the low level signals (effective levels) inputted from the time modulation signal terminal Data-T and the time durations of the low level signals written into the third light emitting control line EM3 from the first to $N^{th}$ scanning periods. It can be seen that, in the embodiment of the present disclosure, since the time control sub-circuit 10 is added, it is possible to realize $2^p$ kinds of controls for light emitting time duration of each pixel.

It should be noted that, a partial overlap exist between the time duration during which the time control signal line Ga(B) is written with the low level for the first time and the time duration during which the scanning line Ga(A) is written with an operating level in the data writing and threshold compensation stage, that is, a start time of the time duration during which the time control signal line Ga(B) is written with the low level for the first time is in the data writing and threshold compensation stage.

With continued reference to FIG. 9, in the pixel driving circuit, the data writing sub-circuit 4, the threshold compensation sub-circuit 2, the driving sub-circuit 3, the storage sub-circuit 8, the first reset sub-circuit 1, and the first light emitting control sub-circuit 5 may all be the same as those shown in FIG. 2. Meanwhile, in the embodiment of the present disclosure, a case where the data writing sub-circuit 4, the threshold compensation sub-circuit 2, the driving sub-circuit 3, the storage sub-circuit 8, the first reset sub-circuit 1, and the first light emitting control sub-circuit 5 in the pixel driving circuit are the same as those shown in FIG. 2 is taken as an example for explanation.

It should be noted that the control signals written into the first light emitting control line EM1 and the third light emitting control line EM3 may be the same, that is, the gate electrode of the first time modulation transistor T8 and the gate electrode of the first light emitting control transistor T5 are coupled to a same light emitting control line EM. Certainly, the first light emitting control line EM1 and the third light emitting control line EM3 may be written with different control signals, for example, a low level signal is written to the first light emitting control line EM1 in the entire light emitting stage, that is, the first light emitting control transistor T5 is always turned on in the light emitting. In the embodiment of the present disclosure, a case where the first light emitting control line and the third light emitting control line EM3 write the same control signal, that is, the gate electrode of the first time modulation transistor T8 and the gate electrode of the first light emitting control transistor T5 are coupled to a same light emitting control line EM is taken as an example for explanation.

Figure 10:
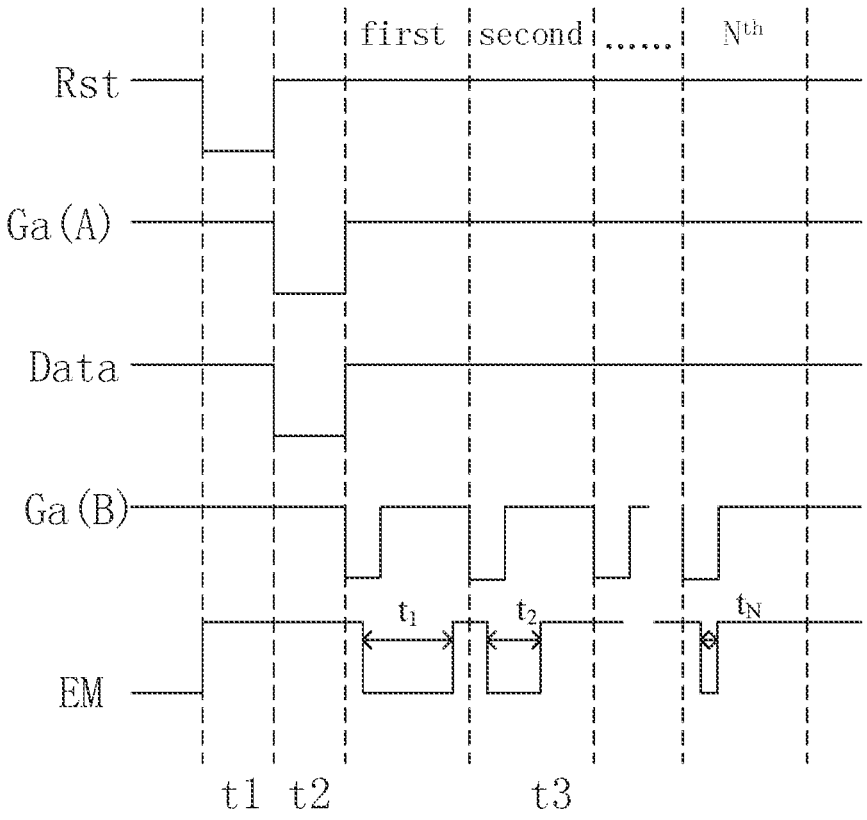
FIG. 10 is a timing diagram illustrating operations of the pixel driving circuit shown in FIG. 9.

FIG. 10 is a timing diagram illustrating operations of the pixel driving circuit shown in FIG. 9; as shown in FIGS. 9 and 10, for example, a case where the time modulation signal terminal Data-T is written with a low signal in three scanning periods of $t_1$-$t_2$ and $t_N$ during the display time of the frame.

The driving method of the pixel driving circuit of the embodiment of the disclosure includes the following stages t1 to t3.

In the reset stage (t1), the reset control signal line Rst is written with a low level signal, and the scanning line Ga(A) and the light emitting control line EM are written with a high level signal; the first reset transistor T1 is turned on, and the gate electrode of the driving transistor T3 is reset by the initial voltage Vinit written by the reset power supply signal line Init, preparing for being written with the data voltage Vdata in the next frame.

In the data writing and threshold compensation stage (t2), a low level signal is written into the scanning line Ga(A), and a high level signal is written into the reset control signal line Rst and the light emitting control line EM; the data writing transistor T4 and the threshold compensation transistor T2 are turned on. The driving transistor T3 is connected into a diode structure by the threshold compensation transistor T2, and the data voltage written into the data line Data is written into the gate electrode of the driving transistor T3 through the data writing transistor T4 and the threshold compensation transistor T2, until the driving transistor T3 is turned off. The voltage of the gate electrode of the driving transistor T3 is Vdata+Vth (Vth<0, Vth being the threshold voltage of the driving transistor T3), and is stored in the storage capacitor Cst. Voltages of the first electrode and the second electrode of the storage capacitor Cst are Vdata+Vth and Vdd respectively; both voltages of the first electrode and the second electrode of the first capacitor C1 are Vdata+Vth.

In the light emitting stage (t3), in the first scanning period, the time control signal line Ga(B) is written with a low level signal, the time modulation signal terminal Data-T is input with a low level signal, the light emitting control line EM is written with a low level signal during a time duration $t_1$=T, the scanning line Ga(A) and the reset control signal line Rst are written with a high level signal, the first light emitting control transistor T5, the first time modulation transistor T8, the second time modulation transistor T9 and the third light emitting control transistor T10 are all turned on, and the light emitting time duration of the light emitting device D in the first scanning period is T; in the second scanning period, the time control signal line Ga(B) is written with a low level signal, the time modulation signal terminal Data-T is input with a low level signal, the light emitting control line EM is written with a low level signal during a time duration $t_2$=T/2, the scanning line Ga(A) and the reset control signal line Rst are written with a high level signal, the first light emitting control transistor T5, the first time modulation transistor T8, the second time modulation transistor T9 and the third light emitting control transistor T10 are all turned on, and the light emitting time duration of the light emitting device D in the second scanning period is T/2; in the $N^{th}$ scanning period, the time control signal line Ga(B) is written with a low level signal, the time modulation signal terminal Data-T is input with a low level signal, the light emitting control line EM is written with a low level signal during a time duration $t_N=T/2^{(N-1)}$, the scanning line Ga(A) and the reset control signal line Rst are written with a high level signal, the first light emitting control transistor T5, the first time modulation transistor T8, the second time modulation transistor T9 and the third light emitting control transistor T10 are all turned on, and the light emitting time duration of the light emitting device D in the $N^{th}$ scanning period is $T/2^{(N-1)}$; in the third to $(N-1)^{th}$ scanning periods, the modulation signal terminal Data-T is written with a high level signal, the third light emitting control transistor T10 is turned off, and the light emitting device D does not emit light, that is, a total light emitting time duration of the light emitting device D is $T+T/2+T/2^{(N-1)}$ during the display time of the frame. Meanwhile, the source electrode of the driving transistor T3 is coupled to the first power supply voltage line VDD in the light emitting stage, and the voltage of the source electrode of the driving transistor T3 is instantaneously changed to Vdd from Vdata in the previous stage. The voltage of the drain electrode of the driving transistor T3 is changed from Vdata+Vth in the previous stage to Vdd+Vds, where the value of Vdata depends on the gray scale value to be displayed by the light emitting device D, and Vds is the voltage across the source electrode and the drain electrode of the driving transistor T3, and the voltage value of Vds depends on the driving current corresponding to the gray scale value to be displayed by the light emitting device D. In some implementations, Vds ranges from about −3V to about −5V, Vth ranges from about −0.7V to about −1.3V, and the maximum voltage difference between Vdd and Vdata is not more than 5V, (Vdd+Vds)−(Vdata+Vth) is about 1V, and thus under bootstrap action of the first capacitor C1, the voltage of the gate electrode of the driving transistor T3 is changed by only about 1V with respect to the voltage Vdata+Vth in the previous stage, and is approximately Vdata+Vth, that is, even though there is a relatively large coupling capacitor Cgs between the gate electrode and the source electrode of the driving transistor T3, when there is a significant instantaneous change in the voltage of the source electrode of the driving transistor T3, due to the presence of the first capacitor C1, there is no significant instantaneous change in the voltage of the gate electrode of the driving transistor T3.

In addition, the light emitting device D emits light under the driving of the driving transistor T3, and at this time, the driving transistor T3 operates in a saturation region, the voltage of the gate electrode of the driving transistor T3 is Vdata+Vth, and the voltage of the source electrode of the driving transistor T3 is Vdd, and thus the gate-source voltage of the driving transistor T3 is vgs=(Vdata+Vth)−Vdd, until the reset stage of the next frame.

The light emitting current of the light emitting device D is equal to the current flowing through the driving transistor T3, which is expressed as follows:

$$\begin{aligned} I_D &= \beta(Vgs - Vth)^2 \\ &= \beta(Vdata + Vth - Vdd - Vth)^2 \\ &= (Vdata - Vdd)^2. \end{aligned} \tag{1}$$

Here, $$\beta = \frac{1}{2}\mu_n C_{ox}\left(\frac{W}{L}\right),$$

$\mu_n$ is an electron mobility of the driving transistor T3, $C_{ox}$ is an insulation capacitance per unit area, and $$\frac{W}{L}$$

is a width-to-length ratio of the driving transistor T3.

As shown in the above formula (1), the current of the light emitting device D is independent of the threshold voltage of the driving transistor T3 during the light emitting stage, and thus the influence of the threshold voltage of the driving transistor T3 on the display uniformity of the display panel is avoided.

In summary, in the embodiment of the present disclosure, the effective light emitting luminance of the light emitting device D in a frame of image in the pixel driving circuit can be determined by a plurality of factors, such as the number of scanning periods in the frame of image, the duration of each scanning period, the first data voltage Vdata_A, the second data voltage Vdata_B, and the light emitting control signal provided by the light emitting control signal line EM, so that the sub-pixel having the pixel driving circuit can display more gray-scale values, and the display panel can display more rich and finer images.

In a second aspect, an embodiment of the present disclosure further provides a display panel, which includes any one of the pixel driving circuits described above, the display panel of the present embodiment has a better display effect and can achieve a high-resolution display.

The display panel may be a liquid crystal display device or an electroluminescent display device, such as a liquid crystal panel, an OLED panel, a Micro LED panel, a Mini LED panel, a mobile phone, a tablet computer, a television, a display, a notebook computer, a digital photo frame, a navigator, or any other product or component with a display function.

It will be understood that the above embodiments are merely exemplary embodiments adopted to illustrate the principles of the present disclosure, and the present disclosure is not limited thereto. It will be apparent to those skilled in the art that various modifications and improvements can be made without departing from the spirit and scope of the present disclosure, and such modifications and improvements are considered to be within the scope of the present disclosure.

The invention claimed is:

1. A pixel driving circuit, comprising: a data writing sub-circuit, a threshold compensation sub-circuit, a driving sub-circuit, a storage sub-circuit and a voltage maintaining sub-circuit, wherein, the data writing sub-circuit is configured to transmit a data voltage signal to a first terminal of the driving sub-circuit in response to a first scanning signal;

the threshold compensation sub-circuit is configured to compensate for a threshold voltage of the driving sub-circuit in response to a second scanning signal;

the storage sub-circuit is configured to store the data voltage signal;

the driving sub-circuit is configured to provide a driving current for a light emitting device to be driven according to voltages of a first terminal and a control terminal of the driving sub-circuit;

the voltage maintaining sub-circuit is configured to maintain the voltage of the control terminal of the driving sub-circuit when the voltage of the first terminal of the driving sub-circuit jumps, the pixel driving circuit further comprising:

a time control sub-circuit configured to control a light emitting time duration of the light emitting device to be driven through a time modulation signal and a third light emitting control signal in response to a time control signal.

2. The pixel driving circuit of claim 1, wherein the voltage maintaining sub-circuit comprises a first capacitor having a first electrode coupled to the control terminal of the driving sub-circuit and a second electrode coupled to a second terminal of the driving sub-circuit.

3. The pixel driving circuit of claim 1, wherein the voltage maintaining sub-circuit comprises a first capacitor having a first electrode coupled to the control terminal of the driving sub-circuit and a second electrode coupled to a reference voltage terminal.

4. The pixel driving circuit of claim 2, wherein the first capacitor has a capacitance ranging from 0.1 pF to 10 pF.

5. The pixel driving circuit of claim 1, further comprising:

a first light emitting control sub-circuit configured to control whether a first voltage is written to a first terminal of a first driving sub-circuit of the driving sub-circuit in response to a first light emitting control signal.

6. The pixel driving circuit of claim 5, wherein the first light emitting control sub-circuit comprises a first light emitting control transistor;

a first electrode of the first light emitting control transistor is coupled to a first power supply voltage line, a second electrode of the first light emitting control transistor is coupled to the first terminal of the driving sub-circuit, and a control electrode of the first light emitting control transistor is coupled to a first light emitting control line.

7. The pixel driving circuit of claim 1, further comprising:

a first reset sub-circuit configured to reset the voltage of the control terminal of the driving sub-circuit through a first initialization signal in response to a first reset control signal.

8. The pixel driving circuit of claim 7, wherein the first reset sub-circuit comprises a first reset transistor;

a first electrode of the first reset transistor is coupled to a first initialization signal terminal, a second electrode of the first reset transistor is coupled to the control terminal of the driving sub-circuit, and a control electrode of the first reset transistor is coupled to a first reset control signal line.

9. The pixel driving circuit of claim 1, further comprising:

a second light emitting control sub-circuit configured to allow a current between the driving sub-circuit and the light emitting device to be driven in response to a second light emitting control signal or not.

10. The pixel driving circuit of claim 9, wherein the second light emitting control sub-circuit comprises a second light emitting control transistor;

a first electrode of the second light emitting control transistor is coupled to the second terminal of the driving sub-circuit, a second electrode of the second light emitting control transistor is coupled to a first electrode of the light emitting device to be driven, and a control electrode of the second light emitting control transistor is coupled to a second light emitting control line.

11. The pixel driving circuit of claim 1, further comprising:

a second reset sub-circuit configured to initialize the light emitting device to be driven by a second initialization signal in response to a second reset control signal, wherein the second reset sub-circuit comprises a second reset transistor;

a first electrode of the second reset transistor is coupled to the first electrode of the light emitting device to be driven, a second electrode of the second reset transistor is coupled to a second initialization signal terminal, and a control electrode of the second reset transistor is coupled to a second reset control signal line.

12. The pixel driving circuit of claim 1, wherein the time control sub-circuit comprises a first time modulation transistor, a second time modulation transistor, a third light emitting control transistor, and a second capacitor;

a first electrode of the first time modulation transistor is coupled to the second terminal of the driving sub-circuit, a second electrode of the first time modulation transistor is coupled to a first electrode of the third light emitting control transistor, and a control electrode of the first time modulation transistor is coupled to a third light emitting control line;

a first electrode of the second time modulation transistor is coupled to a time modulation signal terminal, a second electrode of the second time modulation transistor is coupled to a control electrode of the third light emitting control transistor, and a control electrode of the second time modulation transistor is coupled to a time control signal line;

a second electrode of the third light emitting control transistor is coupled to the first electrode of the light emitting device to be driven, and a control electrode of the third light emitting control transistor is coupled to a first electrode of the second capacitor;

a second electrode of the second capacitor is coupled to a common voltage terminal.

13. The pixel driving circuit of claim 12, wherein the third light emitting control line is configured to be written with operation level signals for a plurality of times within a display time of a frame, and time durations of operation level signals which are written are not equal to each other.

14. The pixel driving circuit of claim 1, wherein the driving sub-circuit comprises a driving transistor, the threshold compensation sub-circuit comprises a threshold compensation transistor, the data writing sub-circuit comprises a data writing transistor, and the storage sub-circuit comprises a storage capacitor;

a first electrode of the driving transistor is used as the first terminal of the driving sub-circuit, a second electrode of the driving transistor is used as the second terminal of the driving sub-circuit, and a control electrode of the driving sub-circuit is used as the control terminal of the driving sub-circuit;

the first electrode of the driving transistor is coupled to a second electrode of the data writing transistor, the second electrode of the driving transistor is coupled to a first electrode of the threshold compensation transistor, and the control electrode of the driving transistor is coupled to a second electrode of the threshold compensation transistor and a first electrode of the storage capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to a first power supply voltage line.

15. The display substrate of claim 14, wherein the storage capacitor has a capacitance ranging from 0.1 pF to 10 pF.

16. A pixel driving circuit, comprising: a data writing sub-circuit, a threshold compensation sub-circuit, a driving sub-circuit, a storage sub-circuit, a first light emitting control sub-circuit, a second light emitting control sub-circuit, a first reset sub-circuit, a second reset sub-circuit and a voltage maintaining sub-circuit; wherein, the driving sub-circuit comprises a driving transistor, the threshold compensation sub-circuit comprises a threshold compensation transistor, the data writing sub-circuit comprises a data writing transistor, the storage sub-circuit comprises a storage capacitor, the first light emitting control sub-circuit comprises a first light emitting control transistor, the second light emitting control sub-circuit comprises a second light emitting control transistor, the first reset sub-circuit comprises a first reset transistor, the second reset sub-circuit comprises a second reset transistor, and the voltage maintenance sub-circuit comprises a first capacitor;

a first electrode of the driving transistor is coupled to a second electrode of the data writing transistor and a second electrode of the first light emitting control transistor, a second electrode of the driving transistor is coupled to a first electrode of the threshold compensation transistor, and a control electrode of the driving transistor is coupled to a second electrode of the threshold compensation transistor, a first electrode of the storage capacitor and a first electrode of the first capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to a first power supply voltage line;

a first electrode of the first light emitting control transistor is coupled to a first power supply voltage line, and a control electrode of the first light emitting control transistor is coupled to a first light emitting control line;

a first electrode of the second light emitting control transistor is coupled to the second electrode of the driving transistor, a second electrode of the second light emitting control transistor is coupled to a first electrode of a light emitting device to be driven, and a control electrode of the second light emitting control transistor is coupled to a second light emitting control line;

a first electrode of the first reset transistor is coupled to a first initialization signal terminal, a second electrode of the first reset transistor is coupled to the control electrode of the driving transistor, and a control electrode of the first reset transistor is coupled to a first reset control signal line;

a first electrode of the second reset transistor is coupled to the first electrode of the light emitting device to be driven, a second electrode of the second reset transistor is coupled to a second initialization signal terminal, and a control electrode of the second reset transistor is coupled to a second reset control signal line;

a second electrode of the first capacitor is coupled to the second electrode of the driving transistor or a reference voltage terminal.

17. A pixel driving circuit, comprising: a data writing sub-circuit, a threshold compensation sub-circuit, a driving sub-circuit, a storage sub-circuit, a first light emitting control sub-circuit, a first reset sub-circuit, a time control sub-circuit and a voltage maintaining sub-circuit; wherein, the driving sub-circuit comprises a driving transistor, the threshold compensation sub-circuit comprises a threshold compensation transistor, the data writing sub-circuit comprises a data writing transistor, the storage sub-circuit comprises a storage capacitor, the first light emitting control sub-circuit comprises a first light emitting control transistor, the second light emitting control sub-circuit comprises a second light emitting control transistor, the first reset sub-circuit comprises a first reset transistor, the second reset sub-circuit comprises a second reset transistor, the time control sub-circuit comprises a first time modulation transistor, a second time modulation transistor, a third light emitting control transistor and a second capacitor, and the voltage maintaining sub-circuit comprises a first capacitor;

a first electrode of the driving transistor is coupled to a second electrode of the data writing transistor and a second electrode of the first light emitting control transistor, a second electrode of the driving transistor is coupled to a first electrode of the threshold compensation transistor, and a control electrode of the driving transistor is coupled to a second electrode of the threshold compensation transistor, a first electrode of the storage capacitor and a first electrode of the first capacitor;

a first electrode of the data writing transistor is coupled to a data line, and a control electrode of the data writing transistor is coupled to a first scanning line;

a control electrode of the threshold compensation transistor is coupled to a second scanning line;

a second electrode of the storage capacitor is coupled to a first power supply voltage line;

a first electrode of the first light emitting control transistor is coupled to the first power supply voltage line, and a control electrode of the first light emitting control transistor is coupled to a first light emitting control line;

a first electrode of the first reset transistor is coupled to a first initialization signal terminal, a second electrode of the first reset transistor is coupled to the control electrode of the driving transistor, and a control electrode of the first reset transistor is coupled to a first reset control signal line;

a first electrode of the first time modulation transistor is coupled to the second electrode of the driving transistor, a second electrode of the first time modulation transistor is coupled to a first electrode of the third light emitting control transistor, and a control electrode of the first time modulation transistor is coupled to a third light emitting control line;

a first electrode of the second time modulation transistor is coupled to a time modulation signal terminal, a second electrode of the second time modulation transistor is coupled to a control electrode of the third light emitting control transistor, and a control electrode of the second time modulation transistor is coupled to a time control signal line;

a second electrode of the third light emitting control transistor is coupled to a first electrode of a light emitting device to be driven, and a control electrode of the third light emitting control transistor is coupled to a first electrode of the second capacitor;

a second electrode of the second capacitor is coupled to a common voltage terminal.

18. A display panel, comprising a plurality of pixel units, each of the pixel units including a pixel driving circuit and a light emitting device; wherein the pixel driving circuit comprises the pixel driving circuit of claim 1.

19. The pixel driving circuit of claim 3, wherein the first capacitor has a capacitance ranging from 0.1 pF to 10 pF.

* * * * *